US006007313A

United States Patent [19]

Sigel et al.

[11] Patent Number: 6,007,313

[45] Date of Patent: Dec. 28, 1999

[54] CARRIER PARTS FOR BARREL PUMP

[75] Inventors: Thomas Sigel, Kreuzwertheim; Volker Fertig, Wertheim, both of Germany

[73] Assignee: Lutz Pumpen GmbH & Co., KG, Wertheim, Germany

[21] Appl. No.: 08/833,913

[22] Filed: Apr. 10, 1997

[30] Foreign Application Priority Data

Apr. 11, 1996 [DE] Germany ..... 196 14 350

[51] Int. Cl.[6] ..... F04B 17/03; F04D 13/06

[52] U.S. Cl. ..... 417/424.1

[58] Field of Search ..... 417/423.6, 423.1, 417/423.12, 904, 424.1

[56] References Cited

U.S. PATENT DOCUMENTS 4,875,827 10/1989 Gschwender et al. ..... 415/111

*Primary Examiner*—Timothy S. Thorpe
*Assistant Examiner*—Liem Nguyen
*Attorney, Agent, or Firm*—McAulay Nissen Goldberg Kiel & Hand, LLP

[57] ABSTRACT

A barrel pump has a main pump pipe set comprising an outer housing jacket and a supporting pipe received therein for a rotor shaft. Either a carrier part with an individual sliding ring seal or a carrier part which corresponds in its outer dimensions to the carrier part and has a leakage channel for ascending liquid can be screwed onto the lower end of this main pump pipe set. The rotor shaft projects beyond this main pipe pump set. It is also possible for a carrier part with a leakage channel and a double sliding ring seal arranged in the region of the leakage channel to be screwed on. Due to their identical outer dimensions, the carrier parts are interchangeable. A pump base which encloses the pump rotor and is fastened to the lower end of the rotor shaft can be attached to the lower end of each carrier part.

18 Claims, 6 Drawing Sheets

CARRIER PARTS FOR BARREL PUMP

BACKGROUND OF THE INVENTION

1. Field of the Invention

The invention is directed to a pump, especially a drum pump or barrel pump with a pump rotor which is drivable by a motor via a rotor shaft, by means of which pump rotor the liquid in a ring channel can be pumped up to an outlet connected with the ring channel, this ring channel lying between a supporting pipe having a bearing for the rotor shaft and a tubular housing jacket which form a pump pipe set, wherein the liquid can be sucked up by the pump rotor through an inlet formed in a pump base connected with the housing jacket, and wherein an arrangement for protecting against ascending liquid in the supporting pipe is provided in the lower part of the pump pipe set.

2. Description of the Related Art

In barrel pumps of this type, the arrangement for protecting against ascending liquid can either be formed of a sliding ring seal or can comprise a leakage channel connecting the supporting pipe with the outside of the housing jacket, the liquid ascending in the supporting pipe being drained outward through this leakage channel.

A barrel pump with a sliding ring seal is known, for example, from DE 37 18 325 C2 and a barrel pump with a leakage channel is known, for example, from DE 27 50 801 C2.

The decision about whether to use a pump with a sliding ring seal or with a leakage channel depends on operating factors and often cannot always be determined before such barrel pump is procured. A wrong decision will result in frequent breakdowns and repairs. In many cases, a pump with another type of protection against ascending liquid will have to be acquired. All of this leads to increased costs.

OBJECT AND SUMMARY OF THE INVENTION

The primary object of the present invention is to develop a pump, in particular a barrel pump of the type mentioned above, in such a way that a pump of one type with a sliding ring seal can be converted in a simple manner and with little manufacturing effort to the other pump type with a leakage channel.

According to the invention, this object is met proceeding from a pump of the type indicated above in that the lower part of the pump pipe set having the protective arrangement is constructed as an exchangeable carrier part for this protective arrangement and can be fixed at the rest of the main pump pipe set. This carrier part can be constructed with a sliding ring seal on the one hand and with a leakage channel on the other hand so that the pump can easily be converted from the pump type With sliding ring seal to the other pump type with a leakage channel simply by exchanging the different carrier parts.

This results in various advantages. A substantial advantage for the consumer consists in that one pump type can be exchanged for the other in a simple manner so that the consumer need not decide absolutely oil a determined type of pump when purchasing the pump since the exchangeable carrier part is relatively cheap. The user is also capable of switching the pump from one type to the other in a simple manner in response to changing operating conditions.

A substantial advantage with respect to the manufacturing of such pumps consists in that different pumps need not be produced; rather, the main part of the pump remains the same for both types of pump and only the lower carrier part is used with a sliding ring seal in some cases and with a leakage channel in other cases, depending on demand.

According to a preferred construction of the invention, at least one pipe coupling which serves as a leakage channel for ascending liquid and connects the interior of the supporting pipe with the outside of the housing jacket is provided as a protective arrangement in the carrier part. This construction is especially adaptable and advantageous because the carrier part can be used, in principle, either for the sliding ring seal pump type or for the leakage channel pump type, that is, for a pump having no seal or packing, wherein, of course, certain modifications are required in the interior of this carrier part for the two pump types.

Regardless of whether or not a leakage channel is provided, in a further development of the invention the carrier part can have at least one preassembled, complete sliding ring seal comprising the counter-ring and the sliding ring which is associated with the rotor shaft and has a contact pressure spring. Since the sliding ring seal is completely preassembled in the carrier part, the attachment or exchange of this carrier part presents no difficulties at all, nor does it require specialized knowledge or special tools, as will be explained hereinafter.

A preferred construction of the sealed type is characterized in that two sliding rings which are oriented in opposite directions and supported against one another by a spring arranged therebetween are provided in the region of the leakage channel. With their sealing sliding surfaces, these sliding rings contact support bodies, respectively, which serve as a counter-ring and simultaneously as a bearing for the rotor shaft sliding therein.

This preferred construction is further characterized in that the spring arranged between the sliding rings is constructed as a helical pressure spring and is secured by each end to a sliding ring so as to be fixed with respect to rotation relative thereto, so that the spring holds the double sliding ring formed in this way on the rotor shaft sliding therein by means of a clamping effect of the torsion of the helical pressure spring produced by the rotation of the sliding rings in opposite directions. The oppositely directed rotation of the sliding rings is due to the fact that the sliding rings rotate oppositely located counter-rings with their sliding surfaces which face away from one another, resulting in a torsion of the helical pressure spring. In this connection, the coiling of the helical pressure spring is selected in such a way that the helical pressure spring contracts and a clamping effect is accordingly exerted on the rotor shaft in the prevailing rotating direction of the rotor shaft. However, this clamping action is not extensive enough to prevent axial displacement of the double sliding ring formed of the two sliding rings in case of different material elongation.

The arrangement of two sliding rings has the decisive advantage that the one spring end need not be supported at a stationary surface. At the high speeds of roughly 10,000 RPM attained by a rotor shaft of a drum or barrel pump, the rotating movement of the contact pressure spring for the sliding ring relative to a stationary surface very quickly leads to wear at this surface, so that a support surface which rotates along with the rotor shaft must be provided for preventing trouble of this kind, which, however, impedes exchange of the carrier parts.

A further substantial advantage of this construction according to the invention consists in that the lower sliding ring is sealed against liquid ascending from below, i.e., from the rotor, and the liquid is accordingly prevented from flowing through the bearing gap between the rotor shaft and the lower bearing, which is particularly advantageous with abrasive liquids. Another seal can be provided at the lower end of the bearing if necessary. The upper sliding ring seals against liquid ascending along the rotor shaft toward the pump motor and is lubricated by this liquid which penetrated via the leakage channel. Thus, as a result of the arrangement of the leakage channel, not only is a lubrication of the sliding ring seal ensured, but the sliding ring seal also worlds in a pressureless region, which benefits the sealing action as well as the life of the sliding ring seal. This construction also ensures that the liquid cannot rise upward to the bearings and the motor in case of failure of a sliding ring seal, especially the lower sliding ring seal, because the liquid can exit from the leakage channel and the pump accordingly still operates as a sealless pump. Due to the floating arrangement of the double sliding ring on the rotor shaft and the resulting displacement possibility of same with different material elongations, the contact pressure force of the two rings against their associated counter-rings is constant, which, in conjunction with the pressureless environment brought about by the arrangement of the leakage channel, results in particularly favorable operating conditions for the sliding ring seal. Since the support bodies serving as counter-rings serve simultaneously as bearings for the rotor shaft, a particularly favorable bearing of the rotor shaft is achieved. These support bodies are made from carbon, so that they have advantageous sliding properties with respect to the rotor shaft as well as with respect to the sliding rings which are made from ceramic material.

A particularly preferred construction of the invention is characterized in that a sliding ring whose sliding surface can be placed against a support body serving as a counter-ring and simultaneously as a bearing for the rotor shaft sliding therein is provided in the region of the leakage channel along with an adjusting ring and a contact pressure spring between the sliding ring and adjusting ring, and in that the adjusting ring can be fixed to the rotor shaft sliding therein. In this construction, the lower sliding ring is replaced by the adjusting ring so as to retain the advantage that the contact pressure spring is supported at a rotating part at a stationary part, so that this end of the contact pressure spring associated with the adjusting ring is not exposed to wear as occurs in constructions in which this end of the contact pressure spring is supported at a stationary part and is accordingly subjected to intensive wear at high rates of rotation. In other respects, the same advantages apply as in the above-described construction with the two sliding rings, wherein an advantage over the first embodiment form described consists in that production costs are decreased because the second sliding ring is dispensed with. Due to the arrangement of this sliding ring seal in the region of a leakage channel, the lower sliding ring can easily be omitted, since the matter at hand is only that of preventing liquid from ascending along the rotor shaft into the upper region of the pump pipe set.

In another construction of the invention, a small bore hole is provided in the pipe coupling forming the leakage channel so that if the filling level in the drum or barrel falls below the leakage channel, a small amount of the pumped liquid from the delivery flow within the pump branches off through this bore hole and is conveyed to the sliding rings which are thus sufficiently cooled and lubricated.

It is further advantageous when a second leakage channel is formed diametrically opposite to the first leakage channel. It is accordingly possible in most cases to free penetrating solid matter from the sliding rings without having to disassemble the pump.

This simple construction of the carrier part in combination with the bearings and the individual or double sliding ring also results in the decisive advantage that these parts can be preassembled in the carrier part so that when this carrier part is exchanged for another carrier part having no sliding ring seal, it is no longer necessary to assemble these individual parts for the first time, so that the carrier parts can also be exchanged by unskilled labor.

If the loss in the flow cross section for the liquid to be pumped which occurs as a result of the construction of the leakage channel and the consequent decrease in the maximum delivery quantity should be unacceptable, the appropriate carrier part can also be outfitted with a conventional sliding ring seal.

In order for the sliding ring seal to be preassembled in complete form, an advantageous further construction of the invention consists in that the two partial supporting pipes have a free distance relative to one another sufficient for the rotating parts of the sliding ring seal or sliding ring seals, in that the counter-ring is fixed in the upper partial supporting pipe and, when two sliding ring seals are provided, also in the lower partial supporting pipe, and in that the rotating parts of the sliding ring seal or sliding ring seals are held by a supporting mandrel which is held in the lower partial supporting pipe so as to be flush with the counter-ring in the free space between the two partial supporting pipes, wherein the supporting mandrel is displaceable during assembly of the pump by means of the rotor shaft which slides in from the top. Due to this construction, the carrier part can be placed on the rotor shaft emerging from the main pump pipe set without requiring specialized knowledge or special tools because the sliding ring is automatically seated in the correct position on the rotor shaft when the supporting mandrel is pressed out.

In another construction of the invention, a protective sleeve is inserted in the carrier part to receive the threaded end piece of the rotor shaft provided for the fastening of the pump rotor when the rotor shaft slides in, so that during assembly neither the bearing for the rotor shaft nor the sliding ring is damaged by the sharp thread at the end of the rotor shaft serving to fasten the pump rotor.

In an advantageous construction of the invention, a plastic tube with good sliding properties which serves as a bearing for the rotor shaft is held in the supporting pipe in the carrier part at least along a portion thereof in order to provide good guidance of the rotor shaft in the carrier part.

If an individual sliding ring seal is used, a good guidance of the rotor shaft is achieved in a further development of the invention in that the plastic tube is inserted into both partial supporting pipes. That is, the useful life of a sliding ring seal depends upon the exact centering of the sliding ring relative to the counter-ring. A particularly good guidance of the rotor shaft and accordingly a good centering and mutual adapting of the two rings forming the sliding ring seal is ensured by arranging the sliding ring seal between two bearings, each of which is formed by a plastic tube.

If the carrier part is constructed with the leakage channel, the plastic tube is preferably inserted only in the lower part of the partial supporting pipe which reaches to the leakage channel and at least one carbon bearing is inserted in the upper part of the supporting pipe when there is no plastic tube, since an especially good bearing support is not required to this extent due to the absence of the sliding ring seal and, moreover, the flowing off of the ascending liquid through the leakage channel may not be impeded. That is, if another bearing were provided above the leakage channel, the liquid would continue to ascend due to the capillary action between the rotor shaft and the plastic tube.

In order to better compensate for dimensional tolerances between the supporting pipe and the plastic tube serving as bearing and, on the other hand, so that liquid which has risen between the rotor shaft and the plastic tube can be drained off again particularly in the region of the main pump pipe set, the plastic tube in an advantageous construction has, at its outer side, a supporting rib which is formed on integral therewith as a coarse thread with a cross section narrowing to a point in the outward direction.

In order to prevent liquid from ascending in the embodiment form with the sliding ring seal in spite of the presence of this sliding ring seal, at least one additional seal for the rotor shaft is provided at the end of the partial supporting pipe located opposite the counter-ring in a further construction of the invention. For safety reasons, it is advisable to provide two such seals which tightly enclose the rotor shaft. This is necessary because sliding ring seals generally have large reciprocal contacting faces at both rings, but can only have small dimensions in barrel pumps due to the confined space. Accordingly, it is not always ensured that the sliding ring seal will seal absolutely reliably after a long period of operation.

In order to facilitate assembly of the carrier part at the main pump pipe set, it is provided in an advantageous construction of the invention that the partial supporting pipe of the carrier part has a smaller outer diameter than the supporting pipe of the main pump pipe set and can slide snugly into the latter, in that the housing jacket of the carrier part has an external thread at its upper end by which the carrier part can be screwed into an internal thread of the housing jacket of the main pump pipe set, and in that the carrier part has a sealing flange at the lower end of the external thread, which sealing flange contacts the lower end of the housing jacket of the main pump pipe set in a sealing manner when the carrier part is screwed in. Therefore, regardless of the configuration of the carrier part, it is only necessary when attaching the carrier part to the main pump pipe set that the carrier part be attached to the projecting rotor shaft and then screwed to the housing jacket of the main pump pipe set, wherein the partial supporting pipe of the carrier part is compulsorily introduced into the supporting pipe of the main pump pipe set when the carrier part is guided onto the rotor shaft.

In principle, the pump base can be constructed in one piece at the carrier part. However, in order to limit the carrier part only to those parts relating to the different configuration of the protection arrangement for protecting against ascending liquid, it is provided in another construction of the invention that the pump base is attachable to the lower end of the carrier part and can be fixed by means of a catch connection. In this way, the construction of the pump base, which is identical for both types of pump, is not required at the carrier part, which would only make this part more expensive.

The invention is explained more fully in the following with reference to an embodiment example shown in the drawing.

DESCRIPTION OF THE PREFERRED EMBODIMENTS

Figure 1:
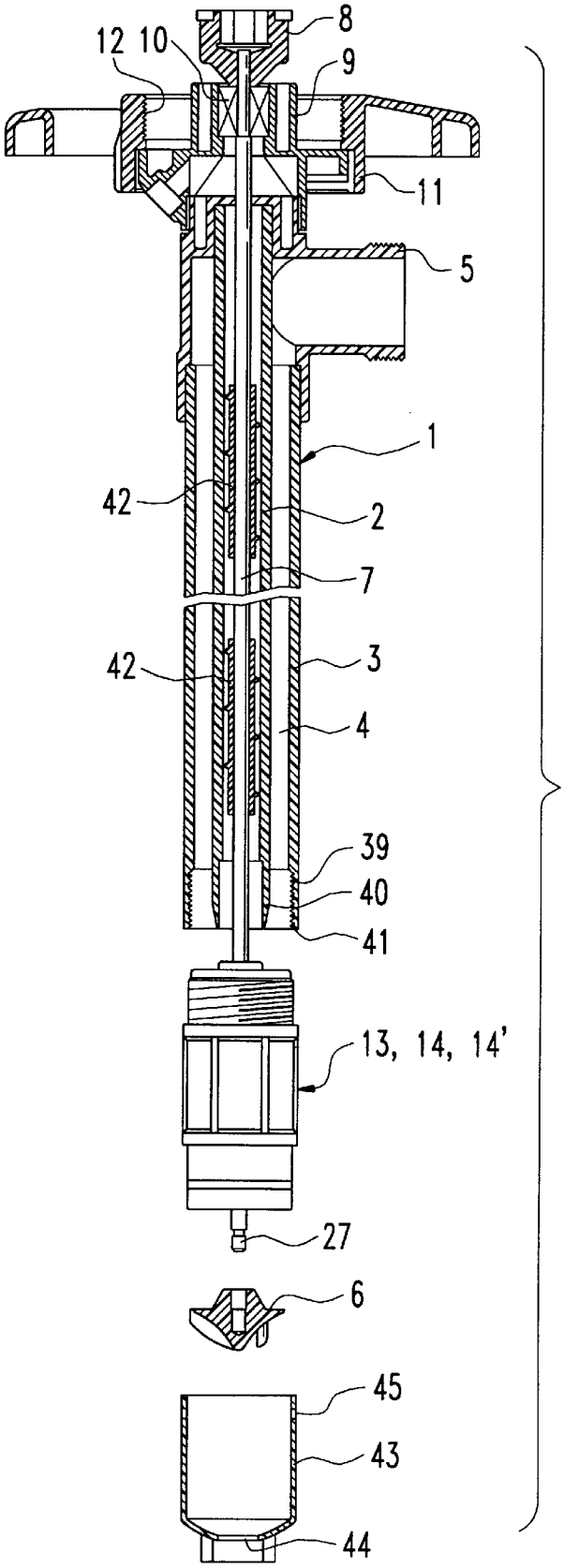
FIG. 1 shows a section through a main pump pipe set with an exchangeable carrier part, partially in an exploded view.

The main pump pipe set of a barrel pump shown in the drawing is designated in its entirety by 1 and comprises a supporting pipe 2 and a housing jacket 3, an annular channel or ring channel 4 being enclosed therebetween. The liquid is pumped up in the ring channel 4 until reaching an outlet piece 5 by means of a pump rotor 6 seated at the lower end of a rotor shaft 7 which runs within the supporting pipe and is provided at its upper end with a coupling 8 by which it is possible to connect it to a driving motor, not shown.

The supporting pipe 2 and the housing jacket 3 are connected at their upper end with an outlet piece 5, to which is screwed a connection head 9 which receives roller bearings 10 for Supporting the rotor shaft 7. A union nut 11 is rotatably supported relative to the connection head 9 and has an internal thread 12 which can be screwed onto a corresponding external thread at the driving motor, not shown, so that the main pump pipe set 1 can be secured with the rotor shaft 7 at the driving motor.

Depending on the existing operating conditions, a carrier part 13, a carrier part 14 or a carrier part 14' can be screwed onto the lower end of the main pump pipe set 1, wherein the carrier parts 13, 14 and 14' which are identically constructed with respect to their outer dimensions have different protective arrangements inside for protecting against ascending liquid.

The carrier part 13 according to FIG. 3 will first be described more fully. In the interior of the jacket 19 of the carrier part 13, two partial supporting pipes 15 and 16 are held at a certain distance from one another at the housing jacket 19 by means of ribs 17 and 18 so as to leave open a free space for a sliding ring 20. In the upper partial supporting pipe 15, which has a greater diameter than the lower partial supporting pipe 16, there is inserted a bearing sleeve 21 carrying in its interior a plastic tube 22 which has especially good sliding characteristics and serves as a bearing for the rotor shaft 7 to be introduced. A plastic tube 23 is likewise inserted in the lower partial supporting pipe 16, although, in this case, the bearing sleeve is omitted since the lower partial supporting pipe has a smaller diameter. The significance of the reduced diameter will be explored more fully in the description of the other carrier part 14 according to FIG. 2.

The counter-ring of the sliding ring seal designated by 24 is pressed together with an O-ring 25 in the lower end of the partial supporting pipe 15. In order that the sliding ring 20 can be held in a preassembled state in the carrier part 13, a supporting mandrel 26 is provided which is inserted in the lower partial supporting pipe 16 within the plastic tube 23 on the one hand and into the sliding ring 20 on the other hand. The sliding ring is accordingly held centrically so that the carrier part 13 can be attached to the projecting part of the rotor shaft 7 in a simple manner. The rotor shaft 7 is not divided and has the necessary length required to receive the pump rotor 6 within the pump base, to be described hereinafter, in the assembled state. In order to protect the sliding ring against damage during this attachment process due to the threaded end piece 27 which is provided at the end of the rotor shaft and serves to fasten the pump rotor 6, a protective sleeve 28 is provided which is inserted partially into the sliding ring 20 and partially into the counter-ring 24. On the one hand, this protective sleeve 28 ensures the centric correspondence of the sliding ring 20 and counter-ring 24 in the preassembled state and on the other hand receives the threaded end piece 27 of the rotor shaft 7 when the carrier part 13 is placed on the rotor shaft 7. The supporting mandrel 26 is pushed down outward through the plastic tube 23 by means of this threaded end piece 27 when the carrier part 13 is attached to the rotor shaft 7. The contact pressure spring 29 which sits atop the supporting mandrel in the preassembled state is supported at the lower partial supporting pipe 16 and can thus cause the sliding ring 20 to be pressed against the counter-ring 24. Two additional seals 30 are provided at the upper end of the partial supporting pipe 15.

Figure 2:
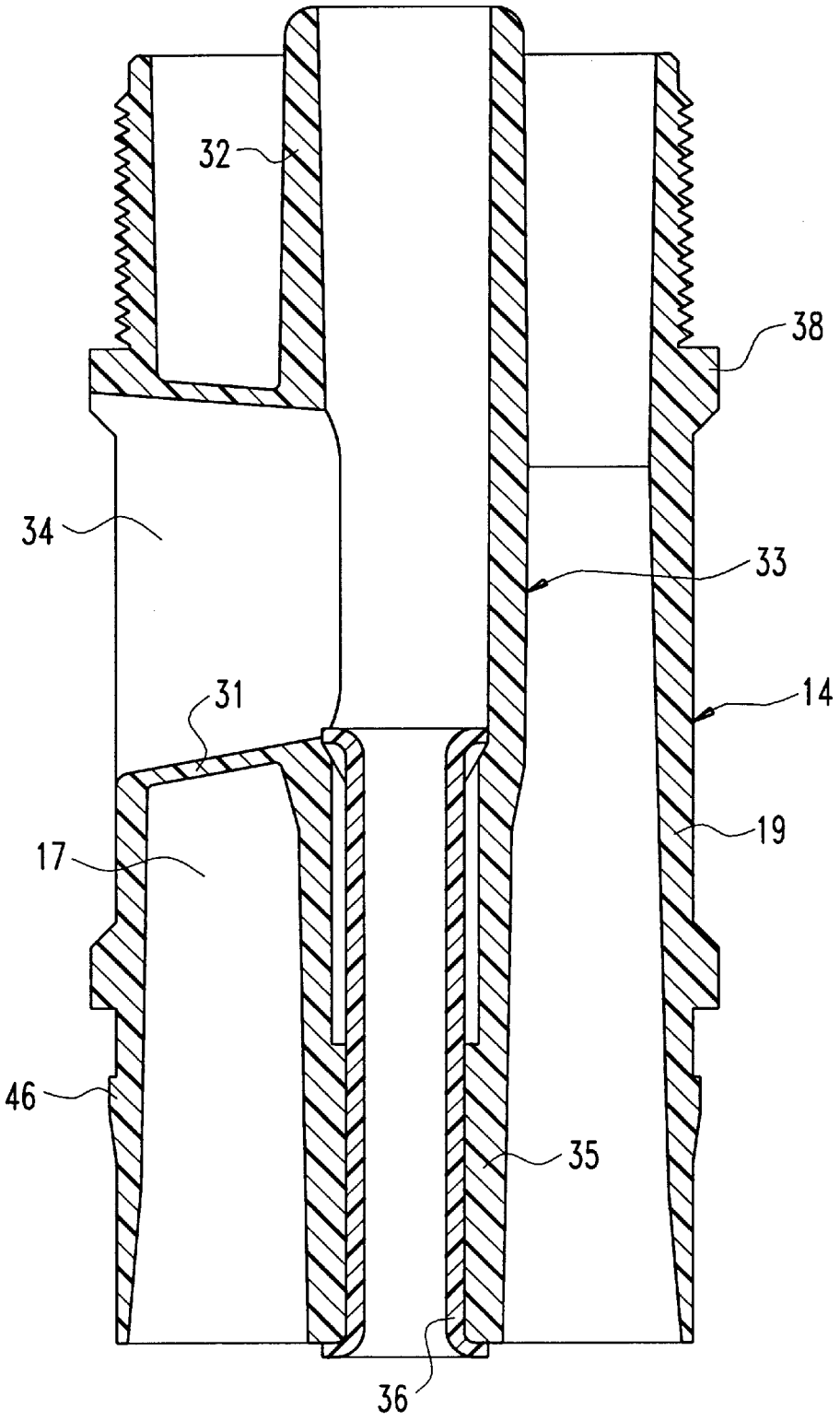
FIGS. 2 to 5 show plan views of different carrier parts.
Figure 3:
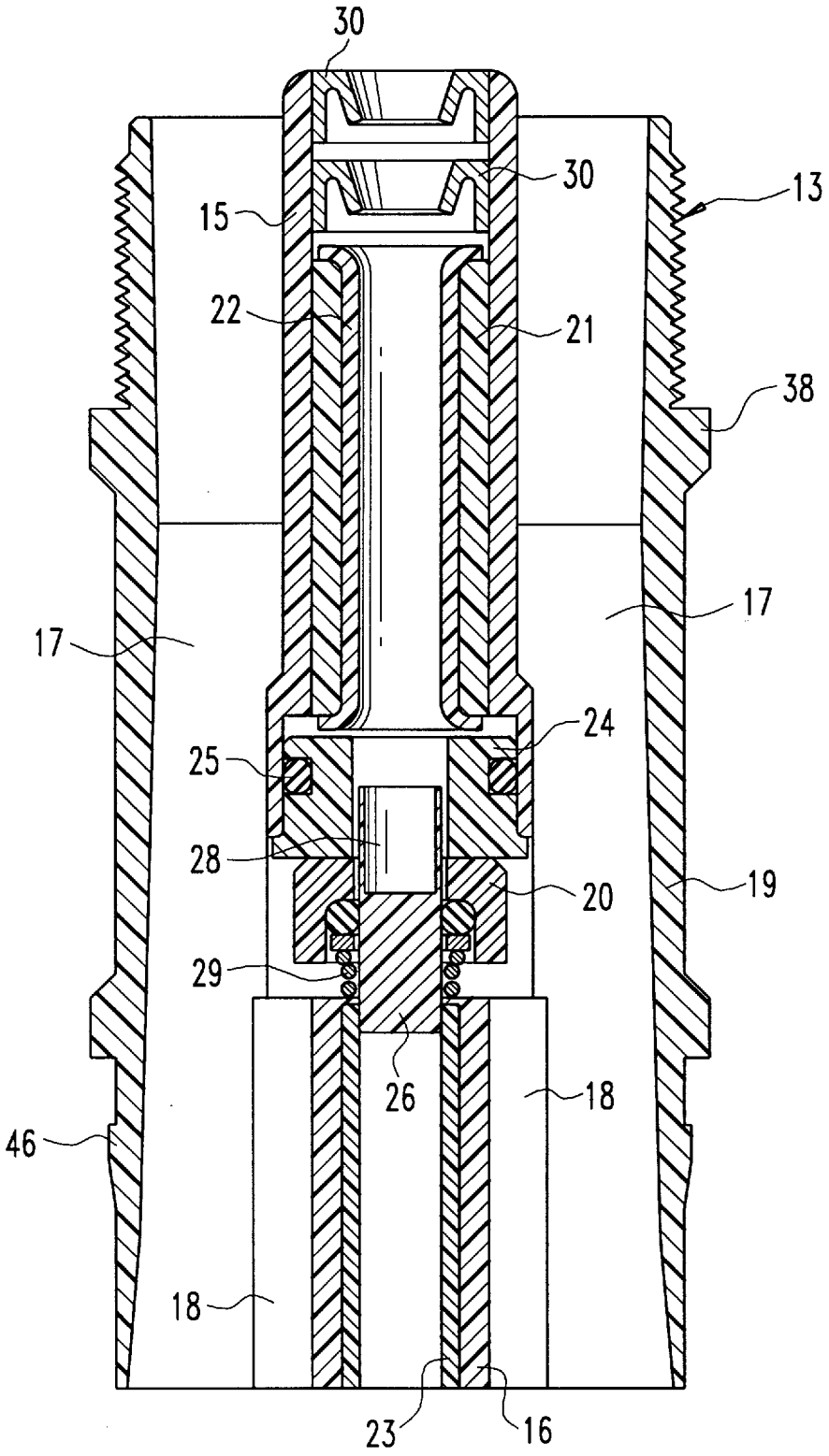

The carrier part 14 according to FIG. 2 is constructed in a substantially simpler manner with respect to the arrangement for protecting against ascending liquid and, instead of the sliding ring seal, comprises a pipe coupling 31 which connects the interior of the upper part 32 of the supporting pipe 33 with the outside of the housing jacket 19 of the carrier part 14. The pipe coupling 31 accordingly forms a leakage channel 34 for liquid ascending along the rotor shaft. In the carrier part 14, in contrast to carrier part 13, there are not two separate partial supporting pipes, but rather a one-piece supporting pipe which comprises an upper part 32, which was already mentioned, and a lower part 35 which is constructed so as to have a smaller diameter than the upper part 32. The lower part 35 of the supporting pipe 33 corresponds in diameter to the lower partial supporting pipe 16 in carrier part 13, while the upper part 32 of the is supporting pipe 33 corresponds to the upper partial supporting pipe 15 in the carrier part 13. The lower part 35 has a plastic tube 36 serving as a bearing for the rotor shaft, while the upper part 32 of the supporting pipe 33 has no plastic tube, so that there remains sufficient play or clearance between the rotor shaft 7 which must still be introduced and the inner wall of the upper part 32 of the supporting pipe 33 to exclude capillary action which could foster ascending liquid. Because of the remaining clearance, the liquid which has ascended between the rotor shaft and plastic tube 36 exits through the leakage channel 34. The larger diameter of the upper part 32 was selected in order to positively ensure that no capillary action occurs. The upper partial supporting part 15 in carrier part 13 is constructed with the same diameter as the upper part 32 so that the injection molds for the carrier parts 13 and 14 can be constructed alike as far as possible in order to achieve economical advantages in production. For this reason, the use of a bearing sleeve 21 in the carrier part 13 is required. The same diameters are also required in the partial supporting pipes 15 and 32 because of the connection with the supporting pipe 2 of the main pump pipe set 1.

Figure 4:
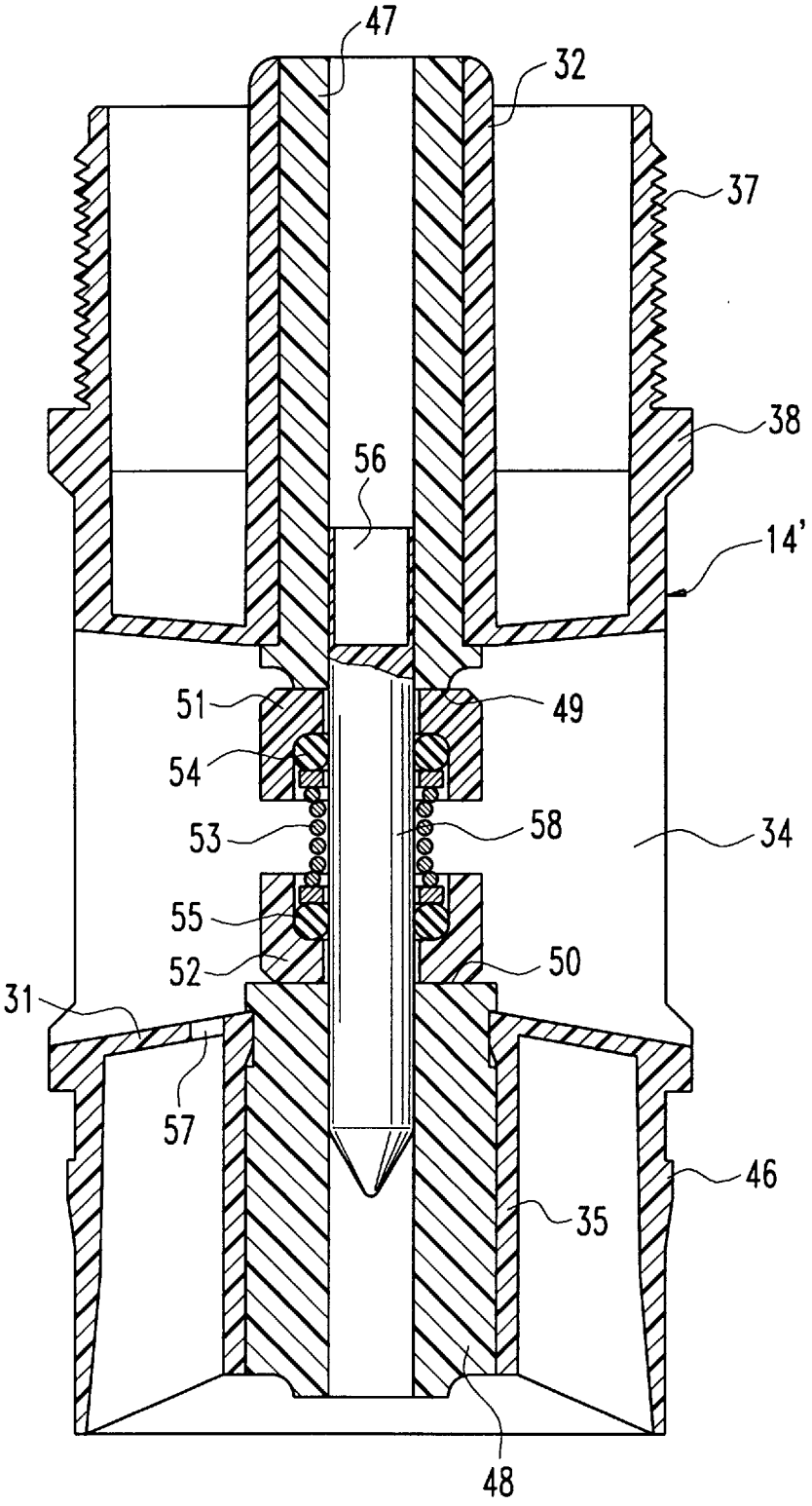

The carrier part 14' according to FIG. 4 to a certain extent represents a combination of the functions of carrier parts 13 and 14. The same reference numbers are used insofar as the parts conform to those of the carrier part 14. In carrier part 14', a support body 47 constructed as a carbon bearing is inserted in the upper part 32 of the partial supporting pipe 33 and a support body 48 constructed as a carbon bearing is inserted in the lower part 35 of the supporting pipe 33. The end faces of these support bodies facing one another form counter-rings 49 and 50 for two sliding rings 51 and 52 which are oppositely arranged and are pressed against the counter-rings by a helical pressure spring 53 arranged between them. The helical pressure spring 53 is connected with the respective sliding rings 51 and 52 so as to be fixed with respect to rotation relative to them and is supported by its ends at the O-rings 54 and 55 inside the respective sliding rings 51 and 52. A protective sleeve 56 is also provided in this embodiment form, specifically at the upper end of the support body 47. This protective sleeve 56 slides onto the threaded end piece 27 when the carrier part 14' is placed on the projecting end of the rotor shaft 7, so that when pushed on farther this threaded end piece cannot damage the support bodies serving as shaft bearings, or the sliding rings or the O-rings arranged in the sliding rings. In the preassembled state, a supporting mandrel 58 receives both sliding rings 51 and 52 as well as the contact pressure spring 53 and holds these parts in the region of the leakage channel 34. In this preassembled state, the supporting mandrel 58 is held in the bearings 47 and 48 provided for the rotor shaft 7 and, when the main pump pipe set is assembled, is displaced by the rotor shaft 7 to be inserted.

Figure 5:
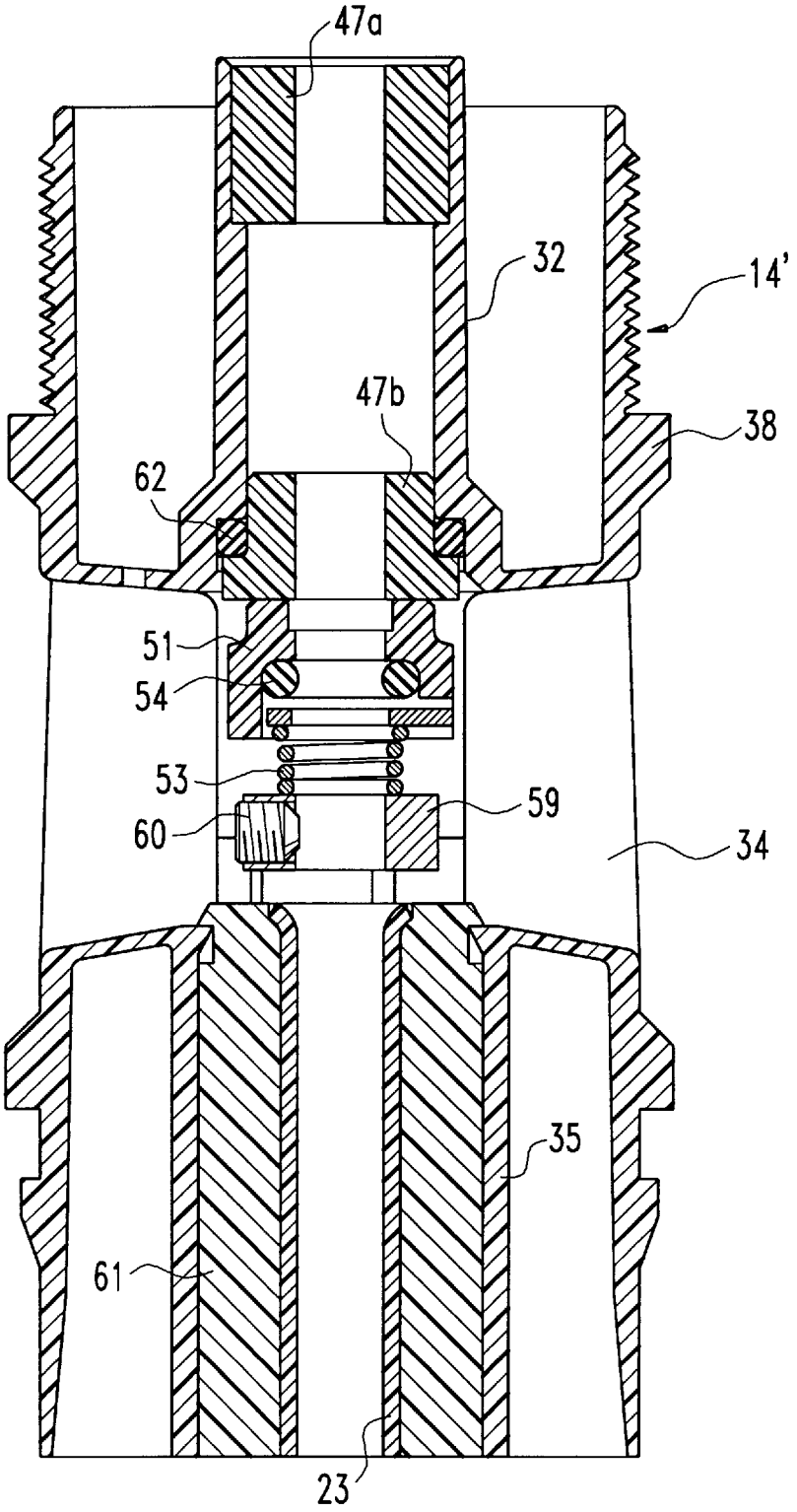

In the construction according to FIG. 5, which shows a particularly preferred carrier part, this carrier part is designated by 14' just as in FIG. 4, since the design of the carrier part corresponds to that shown in FIG. 4. The differences relate to the formation of the bearings and the sliding ring seal. In this embodiment form shown in FIG. 5, only the upper sliding ring 51 is provided, while the lower sliding ring 52 has been replaced by an adjusting ring 59 which can be fixed on the rotor shaft 7 by means of a stud screw 60 after the rotor shaft 7 is inserted. The necessary contact pressure force can be adjusted by the contact pressure spring 53 by means of this adjusting ring 59. As in the embodiment form according to FIG. 3, a plastic tube 23 is provided in the lower partial supporting pipe 35 for the bearing of the rotor shaft, instead of the carbon bearing 48 as is provided in FIG. 4, wherein an additional bushing 61 is provided because of the large inner diameter of the partial supporting pipe 35. A short carbon bearing 47*a* is provided in the upper partial supporting pipe 32 instead of the one-part carbon bearing 47 in contrast to FIG. 4. The structural component part 47*b* is a counter-ring with soft support which can adapt to the sliding ring and is sealed by an O-ring 62 relative to the partial supporting pipe 35.

For manufacturing purposes, it is advisable in carrier part 14 to construct a narrower partial supporting pipe 35 suitable for the insertion of the plastic tube 36 and accordingly to use a tool or die other than this for the production of the carrier part 14', in which the lower partial supporting pipe has a greater diameter for accommodating the support body 48. Of course, it would also be possible to use the carrier part 14' for both constructions and to insert an intermediate sleeve in the lower partial supporting pipe, which intermediate sleeve receives the plastic tube 36 as described with reference to FIG. 5. The carrier parts 14 and 14' conform to one another in other respects.

In carrier part 14', a small bore hole 57 is provided in the connecting web 31 in order to bring liquid into the leakage channel 34 from the ring channel formed between the supporting pipe and housing jacket when the liquid level in the barrel which is to be pumped dry falls below the height of the leakage channel.

The outer dimensions of carrier parts 13, 14 and carrier part 14' are identical, wherein an external thread 37 is formed at the upper ends of each of these carrier parts 13, 14 and 14', the carrier parts having a sealing flange 38 at the lower end. When assembling the main pump pipe set with the respective carrier parts, the appropriate carrier part is first placed on the projecting end of the rotor shaft 7 and then its external thread is screwed into an internal thread 39 of the housing jacket 3. In so doing, the upper end of the upper partial supporting pipe 15 and 32 slides in a snugly fitting manner into a lower end 40 of the supporting pipe 2 which is appropriately adapted in diameter. For this reason, the dimensions of the partial supporting pipe 15 and of supporting pipe 33 must agree in this region so as to enable an exchange of the carrier parts 13, 14 and 14'. At the end of the screwing in process, the sealing flange 38 contacts the lower end 41 of the housing jacket 3 in a sealing manner. Depending upon the length of the pump, the supporting pipe 2 carries one or more plastic tubes 42 for the bearing of the rotor shaft 7.

A pump base 43 is attachable to the lower end of each carrier part 13, 14 and 14'. The pump base 43 has, at its lower end, an inlet 44 for the liquid to be pumped and has a plurality of openings 45 in the region of its upper end. Corresponding projections 46 at the carrier part 13, 14 and 14' lock into these openings 45 when the pump base 43 is attached.

Figure 6:
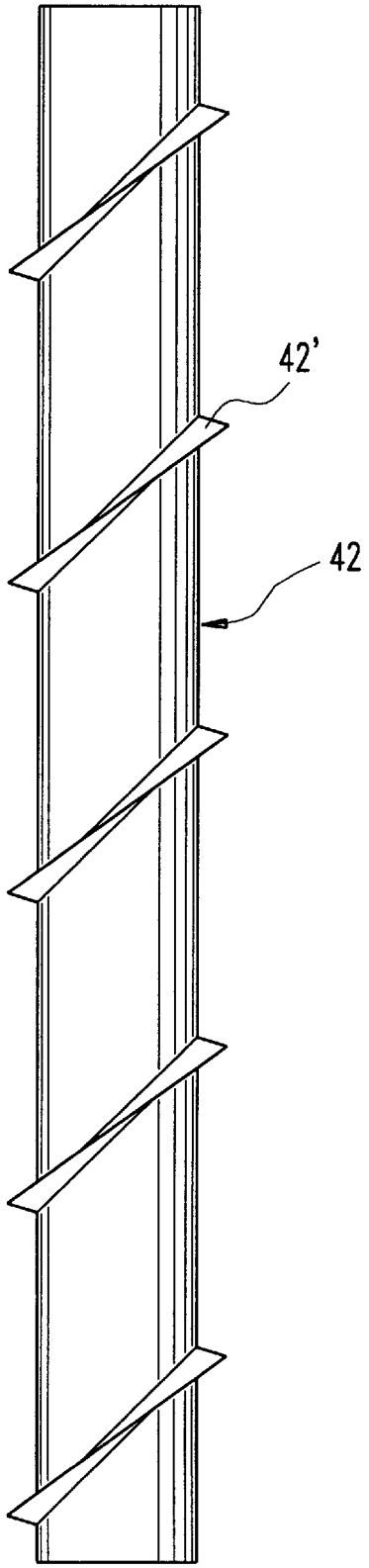
FIG. 6 shows a plan view of a plastic tube serving as a bearing.

FIG. 6 shows a plastic tube 42 such as is used as a bearing in the main pump pipe set 1. The characteristic feature of this plastic tube consists in that it has a support rib 42' at its outer side, which support rib 42' is constructed as a coarse thread and has a cross section which tapers to a point in outward direction. Since the plastic tube does not fill the entire length of the supporting pipe 2 as is shown in FIG. 1, liquid which has climbed up between the rotor shaft 7 and the plastic tube 42 can flow down again between the plastic tube 42 and the supporting pipe 2 owing to the arrangement of the coarse thread on the outside. Because of the shape of the supporting rib 42' which tapers outward to a point, this supporting rib 42' can be deformed relatively easily and accordingly compensates for dimensional tolerances of the supporting pipe 2.

While the foregoing description and drawings represent the present invention, it will be obvious to those skilled in the art that various changes may be made therein without departing from the true spirit and scope of the present invention.

What is claimed is:

1. A pump, comprising:

a pump rotor drivable by a motor via a rotor shaft;

a supporting pipe having a bearing for the rotor shaft;

a tubular housing jacket forming a main pump pipe set, said supporting pipe arranged within said tubular housing jacket;

an outlet coupled to said tubular housing jacket;

a ring channel being formed between said supporting pipe and said tubular housing jacket and extending from said pump rotor to said outlet; said pump rotor pumping liquid located in said ring channel up to said outlet, a pump base having an inlet, the liquid being pumped by the pump rotor through said inlet; and an arrangement for protecting against liquid ascending through the supporting pipe, the protective arrangement being detachably coupled to a lower end of said tubular housing jacket, the protective arrangement being constructed as a carrier part adapted to be secured to and removable from the tubular housing jacket so that different carrier parts may be utilized with the pump.

2. The pump according to claim 1, wherein the carrier part includes at least one pipe coupling serving as a leakage channel for ascending liquid and connecting an interior of the supporting pipe with an outside of the housing jacket.

3. The pump according to claim 1, wherein the carrier part includes at least one preassembled, complete sliding ring seal comprising a counter-ring and a sliding ring associated with the rotor shaft and has a contact pressure spring.

4. The pump according to claim 2, wherein the carrier part includes two sliding rings oriented in opposite directions and supported against one another by a spring arranged therebetween provided in a region of the leakage channel and, with their sealing sliding surfaces, contact support bodies, respectively, serving as a counter-ring and simultaneously as a bearing for the rotor shaft which is to slide in, and wherein the spring arranged between the sliding rings is constructed as a helical pressure spring and is secured by each end at a sliding ring so as to be fixed with respect to rotation relative thereto, the spring holding the double sliding ring by means of a clamping effect of the torsion of the helical pressure spring produced by the rotation of the sliding rings in opposite directions.

5. The pump according to claim 2, wherein the carrier part includes a sliding ring with a sliding surface placed against a support body serving as a counter-ring and simultaneously as a bearing for the rotor shaft provided in a region of the leakage channel along with an adjusting ring and a contact pressure spring between the sliding ring and adjusting ring, and wherein the adjusting ring is fixed to the rotor shaft.

6. The pump according to claim 4, wherein the carrier part includes a small bore hole provided in the pipe coupling forming the leakage channel.

7. The pump according to claim 3, wherein the carrier part includes a second leakage channel formed diametrically opposite to the first leakage channel.

8. The pump according to claim 3, wherein the carrier part includes two partial supporting pipes having a free distance relative to one another sufficient for rotating parts of the sliding ring seals, wherein the counter-ring is fixed in an upper partial supporting pipe and, when two sliding ring seals are provided, also in a lower partial supporting pipe, and wherein the rotating parts of the sliding ring seal or sliding ring seals are held by a supporting mandrel held in the lower partial supporting pipe so as to be flush with the counter-ring in the free space between the two partial supporting pipes, wherein the supporting mandrel is displaceable when the pump is assembled by means of the rotor shaft which slides in from the top.

9. The pump according to claim 1, wherein the carrier part includes a protective sleeve inserted therein to receive a threaded end piece of the rotor shaft provided for the fastening of the pump rotor when the rotor shaft slides in.

10. The pump according to claim 1, wherein the carrier part includes a plastic tube with good sliding properties serving as a bearing for the rotor shaft being held in a partial supporting pipe in the carrier part at least along a portion thereof.

11. The pump according to claim 10, wherein the plastic tube is inserted into both partial supporting pipes.

12. The pump according to claim 10, wherein the plastic tube is inserted only in the lower part of the supporting pipe which reaches to the leakage channel, and at least one carbon bearing is inserted in the upper part of the supporting pipe.

13. The pump according to claim 10, wherein the plastic tube has, at its outer side, a supporting rib which is formed thereon as a coarse thread with a cross section narrowing to a point in an outward direction.

14. The pump according to claim 8, wherein at least one additional seal for the rotor shaft is provided at the end of the partial supporting pipe located opposite the counter-ring.

15. The pump according to claim 8, wherein the partial supporting pipe of the carrier part has a smaller outer diameter than a supporting pipe of the main pump pipe set and can slide snugly into the latter, wherein the housing jacket of the carrier part has an external thread at its upper end by which the carrier part can be screwed into an internal thread of the housing jacket of the main pump pipe set, and wherein the carrier part has a sealing flange at the lower end of the external thread, which sealing flange contacts the lower end of the housing jacket of the main pump pipe set in a sealing manner when the carrier part is screwed in.

16. The pump according to claim 1, wherein the pump base is attachable to a lower end of the carrier part and can be fixed thereto by means of a catch connection.

17. The pump according to claim 5, wherein a small bore hole is provided in the pipe coupling forming the leakage channel.

18. The pump according to claim 1, wherein the tubular housing jacket is adapted to be coupled to a first carrier part having a sliding ring seal adapted to protect against liquid ascending through the supporting pipe, and is adapted to be coupled to a second carrier part having a leakage channel for protecting against liquid ascending through the supporting pipe.

* * * * *